United States Patent [19]

Henningsson

[11] Patent Number: 4,974,843

[45] Date of Patent: Dec. 4, 1990

[54] BALL GAME PRACTICE APPARATUS

[76] Inventor: Bo L. Henningsson, Söpplanda, Blomskog, S-672 00 Årjäng, Sweden

[21] Appl. No.: 339,616

[22] PCT Filed: Sep. 29, 1987

[86] PCT No.: PCT/SE87/00440

§ 371 Date: Mar. 14, 1989

§ 102(e) Date: Mar. 14, 1989

[87] PCT Pub. No.: WO88/02644

PCT Pub. Date: Apr. 21, 1988

[30] Foreign Application Priority Data

Oct. 10, 1986 [SE] Sweden ..... 8604302

[51] Int. Cl.[5] ..... A63B 61/00

[52] U.S. Cl. ..... 273/29 A

[58] Field of Search ..... 273/26 A, 29 A, 179 R, 273/181 A, 182 R, 182 A, 396, 397, 398, 401, 402, 410, 127 C; 124/51 R, 11

[56] References Cited

U.S. PATENT DOCUMENTS 3,911,888 10/1975 Horvath ..... 273/30
3,999,754 12/1976 Krzysztofiak ..... 273/30
4,861,027 8/1989 Thaxton ..... 273/26 A

FOREIGN PATENT DOCUMENTS 2456997 6/1975 Fed. Rep. of Germany ... 273/29 A
2575076 6/1986 France ..... 273/29 A

*Primary Examiner*—Theatrice Brown
*Attorney, Agent, or Firm*—Nixon & Vanderhye

[57] ABSTRACT

The invention relates to a ball game practice apparatus, particularly for tennis practice, comprising a ball catching assembly (2) and a ball collecting assembly (3), which in its turn comprises at least a first chute (30) beneath the ball catching assembly, said ball catching assembly being connected with a ball propulsion assembly (5) via a ball feeding assembly (4). A characteristic feature of the invention is that in the ball collecting assembly (3) between the chute (30) and the ball catching assembly (2) there is a damping device (32), through which the balls must pass and which damps the falling speed of the balls to prevent them from leaving the ball collecting assembly (3) by rebounding from the bottom (33) of the chute. Another characteristic feature of the invention is further that the bottom of said at least first chute (30) consists of a plane, preferably sloping only in the longitudinal direction of the chute.

18 Claims, 4 Drawing Sheets

13
14
15
12
13
12
6
16
30
9
8
45
44
43
50
31
10
11
51
5
52

57
44
56
62
61
58
64
63

20'
26
60°
75°
20
28
3
32
30
33
29
34
34
35
37
31
36
38
23,24
40

29
32
34
30
38
39
36
41
40

BALL GAME PRACTICE APPARATUS

TECHNICAL FIELD

The present invention relates to a ball game practice apparatus, particularly for tennis practice, comprising a ball catching assembly and a ball collecting assembly, which in turn comprises at least a first chute beneath the ball catching assembly, the ball catching assembly being connected with a ball propulsion assembly via a ball feeding assembly. The balls are propelled from the ball propulsion assembly and are returned by the player towards the ball catching assembly, wherefrom the balls via the ball collecting assembly and the ball propulsion assembly are again forwarded for propulsion.

BACKGROUND ART

A practice device of the kind referred to in the preamble is known from the Swedish patent specification No. 366919. This shows a ball catching assembly connected to a ball feeding assembly, from which balls are dropped down against a rebound surface. The rebound surface is tilted inwards towards the ball catching assembly, such that a ball which is dropped from above with the aid of the ball feeding assembly will bounce out from the practice apparatus towards the player.

The known ball catching assembly consists of a canvas against which the balls are directed and from which the balls will fall down into a funnel shaped space having an outlet opening. A disadvantage with this known ball catching assembly is that the balls tend to prevent themselves from falling down through the outlet opening, towards which opening they roll from two opposite directions.

Instead of dropping the balls against a rebound surface it is also known to propel the balls with the aid of compressed air through a propulsion tube, as is described e.g. in the U.S. Pat. No. 3,584,614 and the European patent specification No. A1 0043886.

Training apparatuses of the type mentioned in the preamble are described also in the German patent publication No. 2456997. According to an embodiment shown in FIGS. 2 and 3 the ball collecting assembly consists of a chute of flexible material and having a rounded bottom. The ball catching device consists of canvas which directs the balls such that they will fall down into the chute. Although the chute consists of a flexible material, it cannot be avoided that balls frequently rebound upwards and out of the chute. Further, balls which follow the rear side of the chute may roll down with such a speed along the rear side that they will proceed up over the front edge and in that way escape from the chute. Another drawback with the rounded design, which has been proved during the development of the present invention, is that balls can be jammed towards one another and in that way fasten on their route along the bottom of the chute towards the feeding-out opening, and this tendency can even be greater if the chute is made of a flexible material. FIGS. 14 and 15 in the German patent publication No. 2456998 illustrate another embodiment of a training apparatus according to the preamble. In this case, it is true that the bottom of the chute is essentially flat, which may prevent said jamming of the balls. In order to prevent the rebound effect, the bottom of the chute, however, has been made of a network with sufficiently small mesh size in order to prevent the balls from passing through. A material of this type is not a good roll bed for the balls with the result that the balls may be prevented from rolling to the feeding-out opening in the lowest located point of the chute. Evidently, in order to prevent the balls from rebounding out from the chute over the net, the chute has also been made very broad, which is not a good solution, since it would take a considerable space from the training court at the same time as the practice apparatus will be difficult to stow away when it is not in use.

DISCLOSURE OF THE INVENTION

It is an objective of the invention to provide a ball game practice apparatus which does not have the drawbacks of known ball game practice apparatuses referred to above. According to a first aspect of the invention there is a damping device in the ball collecting assembly between the chute and the ball catching assembly. The balls have to pass this damping device which reduces their velocity of fall. The damping device also will prevent the balls from escaping from the ball collecting assembly by rebounding from the bottom of the chute. According to a second aspect of the invention there is a feature of the invention that the bottom of the chute consists of a flat gradient plane of a comparatively hard and stiff material, and wherein the bottom of the chute is inclined preferably only in the longitudinal direction of the chute. Preferably the bottom breadth of said at least first, flat chute corresponds to between 3 and 12 ball diameters, preferably to between 4 and 10 ball diameters. Ball diameter in this connection relates to the diameter of those balls for which the apparatus is designed.

According to a preferred embodiment the damping device consists of a net stretched out at a distance above the bottom of the chute, the meshes of the net being somewhat but not much wider than the ball diameter. It is therefore unlikely that a ball would fall through the net without touching the net. Still less likely is the possibility that a ball would rebound from the inclined bottom passing through the net again without first being damped by touching the net. As a matter of fact the likelyhood is so small that it can be neglected.

Also other damping devices than nets are in principle conceivable. Among such possibly conceivable devices may be mentioned lines (ropes) stretched out above the chute in the longitudinal direction of the chute as well as in its transversal direction so that the lines will form a net pattern. Further, one can conceive replacing the net by lamellae which extend preferably transversally over the chute, slightly inclined relative to the vertical direction.

By preventing rebounds from the collecting assembly by means of the damping device, which is integrated in the collecting assembly, one has according to the invention got free hands as far as directing the balls down into the collecting assembly is concerned. This implies i.a. that one can allow the balls to drop from the highest level in the catching assembly down towards the collecting assembly without having to count with fatal rebounds. Therefore it is convenient that the catching assembly comprises a wall of comparatively flexible material and that this wall has a smaller inclination against the horizontal direction in its upper part than its lower part, wherethrough it can be prevented that the balls will rebound out from the wall so far that they will miss the collecting assembly below the wall.

A preferred embodiment of the apparatus is further characterized in that the first chute runs into a second chute having rounded bottom, that the second chute slopes towards a ball feeding-out opening, and that the first chute is substantially longer than the second one. Suitable the two chutes slopes towards one another such that they meet in the lowest point of the collecting assembly where the feeding-out opening in a manner per se is located. The damping device covers also the second chute.

According to the embodiment a ball accumulator is further provided between the feeding-out opening and the ball feeding assembly. This by way of example may consist of an inclined tube. The balls may be propelled from a propulsion tube by the aid of an air pressure provided by means of an air exhauster via a pressure chamber. The ball feeding-in device by way of example can be located adjacent to the ball feeding-out opening and may have the form of a turnstile with flexible arms.

Further aspects and characteristic features as well as advantages of the invention will be apparent from the following description of a preferred embodiment. Reference will be made to the accompanying drawings, in which FIG. 1 is a perspective view of the apparatus, from the right and towards the front, FIG. 2 shows, partly schematically, the framework of the apparatus in approximately the same perspective view, FIG. 3 shows the collecting assembly of the apparatus in a view from the right and towards the front, FIG. 4 schematically shows the main parts of the collecting assembly and the ball catching assembly in a vertical section adjacent to the right-hand side of the apparatus in a direction towards the left-hand side of the apparatus, FIG. 5 shows a detail of the catching assembly and a portion of the ball feeding-out assembly at a larger scale, and FIG. 6 shows another part of the ball feeding-out assembly.

DESCRIPTION OF PREFERRED EMBODIMENT

Figure 1:
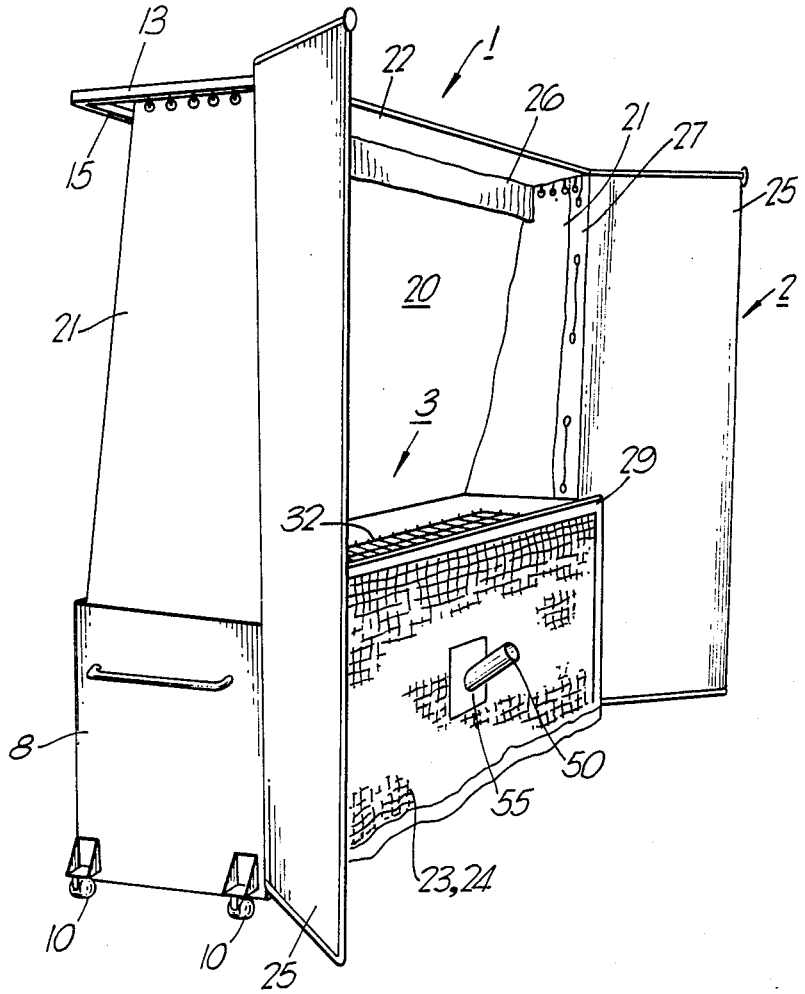
Figure 3:
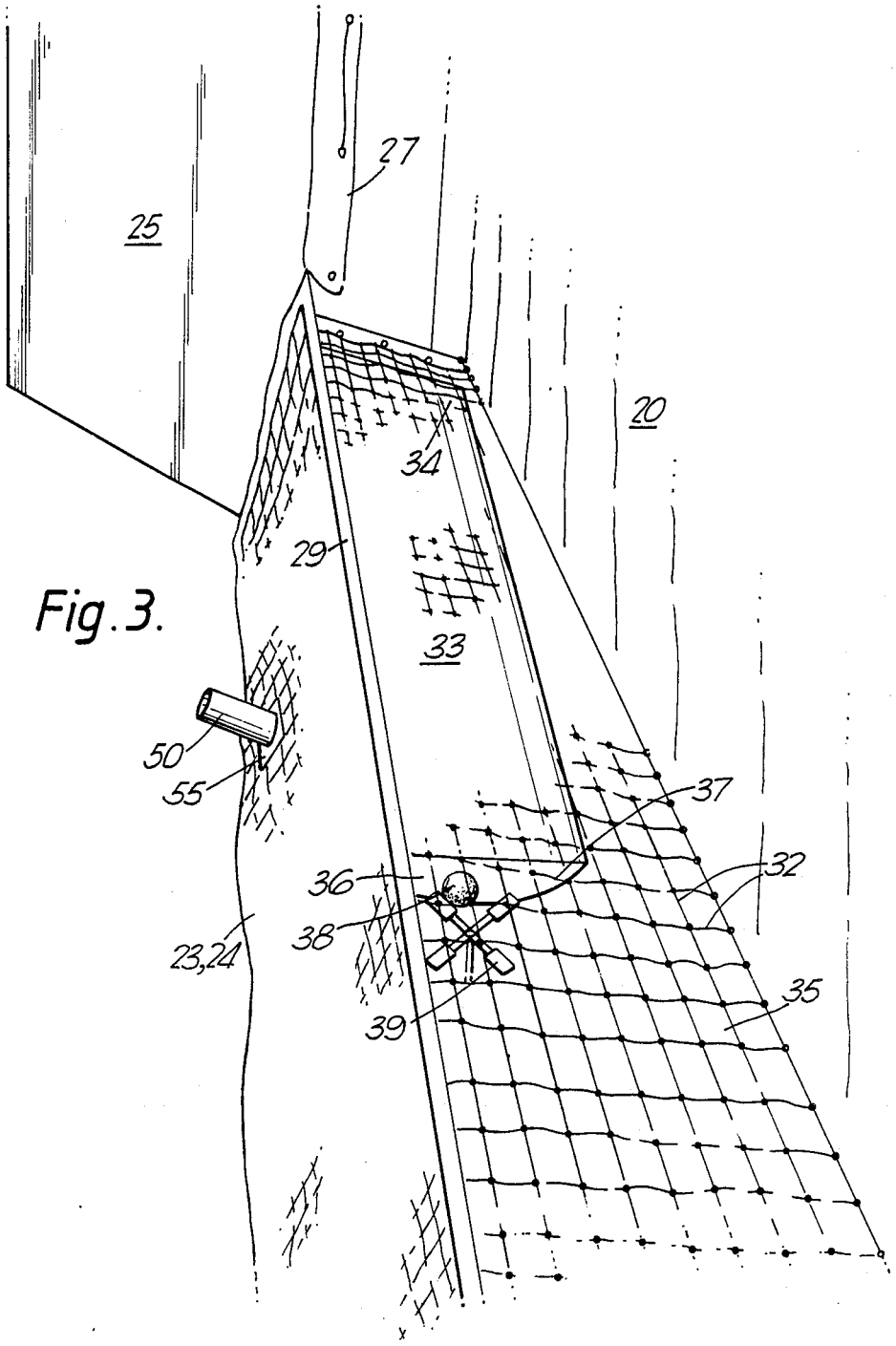
Figure 4:
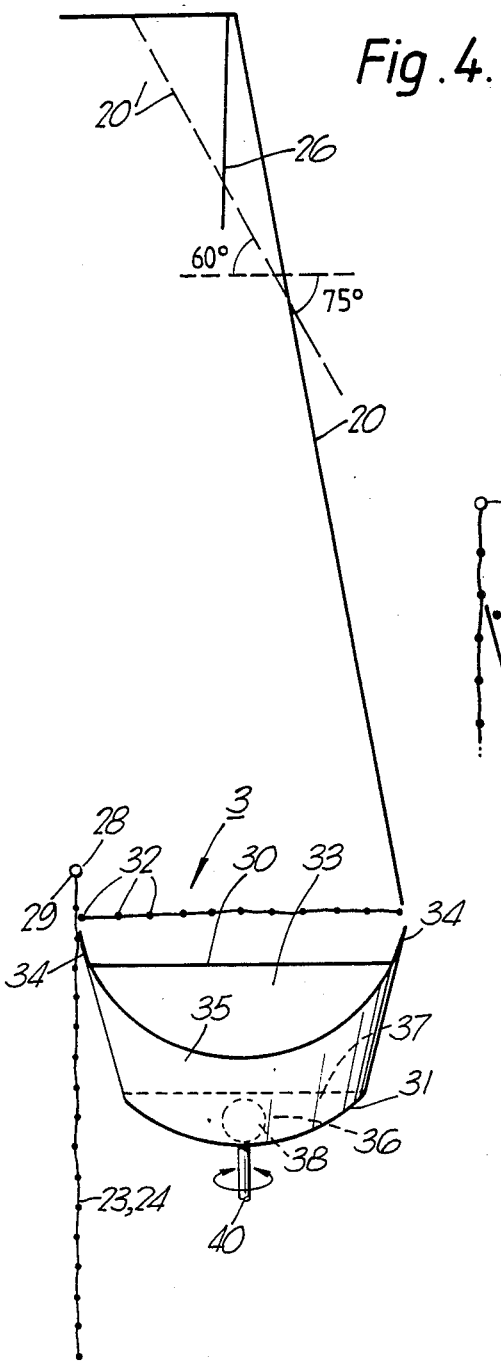
Figure 5:
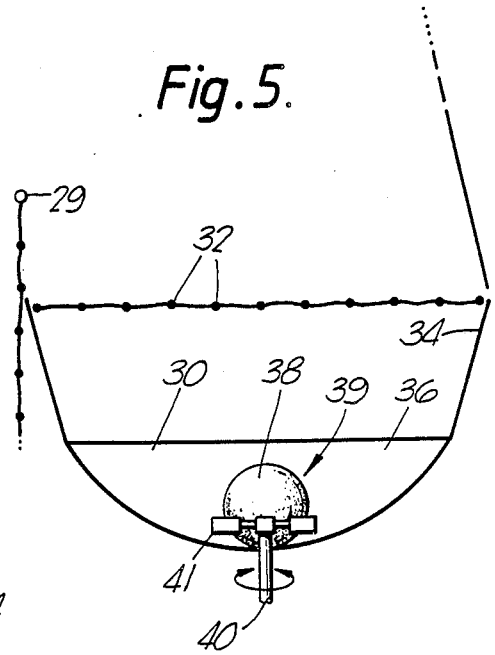

The training apparatus according to the invention has been generally designated 1 in the drawings. It consists of the following parts, namely a ball catching assembly 2, FIG. 1, a ball collecting assembly 3, FIG. 3, a ball feeding assembly and a ball propulsion assembly 5. The practice apparatus 1 is erected on a rack or framework 6, which mainly consists of metal sheet and sheet metal profiles. Other parts in the apparatus 1 mainly consists of canvas or other flexible material.

Figure 2:
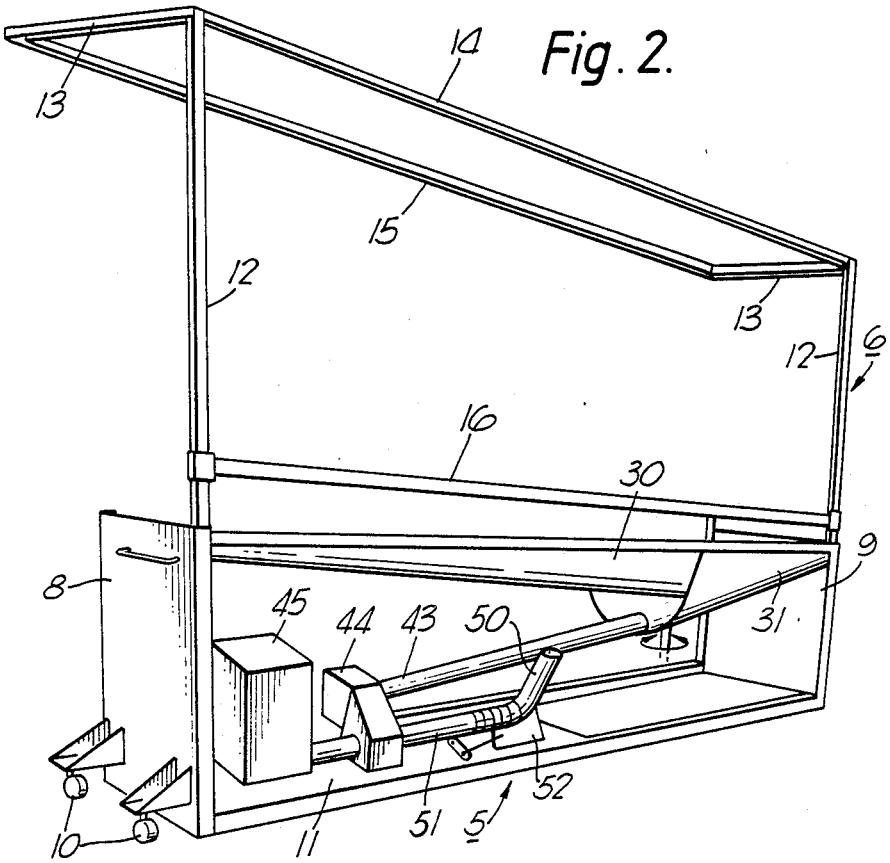

In the framework 6 a lower portion has been designated 7. This consists of a left-hand and a right-hand side panel 8 and 9, respectively. Four wheels mounted on the side sheets have been designated 10. A bottom sheet has been designated 11. Vertical posts are mounted in the corners of the lower portion 7. Mounting posts 12, which can be raised and lowered in the vertical direction extend from the corner posts in the lower portion 7, in which they are telescopically mounted. The mounting posts 12 can be locked in desired position by the aid of knob screws which are not shown in the drawings. At the upper end, each mounting post 12 is provided with a horizontal transverse beam 13 extending at a right angle rearwards. Between the transversal beam 13 there extend two upper canvas rods, a front canvas rod 14 and a rear canvas rod 15 in the same horizontal plane. A lower front canvas rod 16 can be telescopically moved on the mounting posts 12 via sleeves 17 in the ends of said rod 16 and can be locked in desired position by the aid of screws which have not been shown. A rear, lower canvas rod 18, not visible in FIG. 2, is mounted in the rear part of the lower portion 7 at a level which is somewhat lower than that of the lower front canvas rod 16. Details 12–18 constitute the frame-work of the ball catching assembly 2. This consists of a rear catching canvas 20, a pair of side canvases 21 and a roof canvas 22. Between the side panels 8 and 9 and under the lower front canvas rod 16 there is a lower front catching canvas 23 and ahead of this a tennis net 24. Further, there are two wings 25, which also consist of canvas. The wings 25 can hang in the mounting posts 12 by means of fastening members which can be put down into the mounting posts from above and be pivoted in these posts, so that the wings can be turned to desired angular positions.

The rear catching canvas 20 and the side canvases 21 consist of a fine mesh or perforated, comparatively heavy curtain material of the type used for partition purposes in sport halls. Because air can pass through the material the damping effect is improved in spite of the fact that the material is heavy.

The side canvases 21 are mounted on the mounting posts 12 such that they with their front portions extend from the outside around the front side of the mounting posts 12 and thereafter obliquely rearwards-inwards with portions 27 which are obliquely turned inwards. These portions 27 can catch balls which may follow the inside of the side canvases 21 towards the playing area, a tendency which thus can be prevented by the portions 27, such that the balls instead are caught by these portions and directed down into the ball collecting assembly 3.

The lower portion 7 is a welded construction. In other respects the entire apparatus 1 can be dismantled in order to facilitate transport and storage.

The rear catching canvas 20 is inclined somewhat forwards such that caught balls will fall down into the ball collecting assembly 3. 75° is a suitable angle of elevation. High balls may be more difficult to direct down into the collecting assembly 3, as this is comparatively narrow; according to the embodiment 50 cm. There are a number of conceivable methods which can solve this problem. For example a valance 26 may hang freely down from the angle between the rear catching canvas 20 and the roof canvas 22. Alternatively, an upper portion 20' of the rear catching canvas may be inclined under a smaller angle of elevation than the lower main portion of the catching canvas 20. 60° is a suitable angle of elevation for this upper portion 20'.

The ball collecting assembly 3 comprises a first chute 30, a second chute 31 and a damper in the form of a net 32, which is stretched horizontally over the chutes 30, 31 about 12 cm under the upper border 28 of the tennis net 24. The upper portion of the tennis net, which extends beyond the damper, has been designated 29.

The first chute 30 extends from the left-hand side panel 8 in a direction towards the other side panel 9 and has a length corresponding to $\frac{2}{3}$ of the distance between the side panels 8 and 9. The second chute 31 extends from the right-hand side panel 9 and meets the first chute 30. Consequently, it has a length corresponding to $\frac{1}{3}$ of the distance between the two side panels. The two chutes 30 and 31 are made from metal sheet and are covered with cloth on the inside. The first chute 30 has a flat bottom 33 and flat, inwardly sloping sides 34. The total length of the first chute 30 is about 2 m with a total drop of about 10 cm. The sloping angle thus is about 3°. Both smaller and larger sloping angles can be tolerate. The smallest sloping angle, however, should not be less than 1° and preferably not less than 2°, while the largest sloping angle should not be larger than 6° and suitably not larger than 5°. The total breadth of the chutes 30 and 31 according to the embodiment is about 50 cm.

The bottom 35 of the second chute 31 is rounded. It slopes from the right-hand side panel 9 in a direction towards the first chute 30 under a substantially larger sloping angle than the first chute 30. The total drop on a length of 1 m is about 20 cm according to the embodiment. The angle of inclination thus is about 12°. Generally the bottom of the second chute should have an angle of inclination which is 2 à 6 times as large as that of the first chute 30. The second chute 31 is terminated by an end wall 36 beneath the lower edge 37 of the first chute 30. In the end wall 36 there is a feeding-out opening 38 for balls and ahead of this feeding-out opening there is a feeding-out device in the form of a turnstile 39 with a vertical axis of rotation 40 and with four foldable arms 41 made of rubber. The feeding-out turnstile 39 can be rotated in the horizontal plane via the rotation axis 40 by means of a motor which has not been shown. Preferably the rotation is made oscillating a half to a whole revolution in each direction.

The net 32 covers the chutes 30 and 31 completely and is stretched horizontally over the chutes at a height of about 12 cm above the highest point of the chutes 30, 31 adjacent to the two side panels 8, 9. The mesh size is somewhat—5 à 10%—larger than the diameter of a tennis ball, which means that balls only exceptionally will pass through the net without touching it.

The feeding-out opening 38 and the turnstile 39 are parts of the feeding-out assembly, which also includes a ball accumulator in the form of an inclined tube 43, which extends between the feeding-out opening 38 and a feeding-out apparatus 44. Further, the feeding-out assembly includes an air exhauster (blowing fan) which is connected to the feeding-out apparatus 44 which will be described more in detail together with the description of the mode of operation of the apparatus.

The propulsion assembly 5, FIG. 2, includes a propulsion tube 50, which is connected to the feeding-out apparatus 44 via a ball conduit 51. The propulsion tube 50 can be pivoted sidewards about a vertical axis on a bottom support 52 and can be directed in different elevations against the horizontal plane by means of a not shown friction lever on the bottom support 52. The sidewards pivoting movement can be provided by means of a crank mechanism 53, which is powered by an electric motor via a not shown gear wheel. The propulsion tube 50 is connected to the ball conduit 51 via a tube bellow 54. The propulsion tube 50 projects through an opening in the centre of the lower front catching canvas 23 and a corresponding opening 55 in the tennis net 24. The opening in the catching canvas 23 is sealed by a funnel-like canvas portion connected to the rear part of the propulsion tube 50.

The mode of operation of the above described apparatus 1 will now be explained. Balls are returned in the first place against the rear catching canvas 20. Balls missing the canvas 20 may be caught by the wings 25, which are angled such that the balls will be directed towards the catching canvas or directly into the collecting assembly 3. Balls which however do not reach over the tennis net 24 will remain on the "player's half of the court" in the same mode as in normal tennis. Balls which however pass over the net 24 will be caught by the ball catching assembly 2, i.e. by the rear catching canvas 20, the side canvas 21 including its obliquely inwardly turned portions 27, the roof canvas 22 and the wings 25, such that the caught balls will be directed down towards the ball collecting assembly 3.

In the ball collecting assembly 3 the balls will first meet the horizontally stretched damping net 32 which damps the speed of the balls before they pass through the net. The velocity of fall thus has been reduced when the balls hit the bottom of either the first chute 30 or the second chute 31 which are both hard. As the chutes are hard, the balls will rebound, although the velocity has been reduced. In the case of high rebounds, the balls will contact the damping net again, this time from beneath, but the velocity now as a rule is so low that the balls will not pass through the net once again. The net in other words operates as a "back valve" for tennis balls. If this back valve function in exceptional cases would not work, so that a ball would rebound back through the net 32, one can also under these extraordinary circumstances expect that the ball again will fall down upon the net and through it. The balls thus will land either in the first chute 30 or in the second chute 31. If they land in the latter one, they will quickly collect in its bottom portion. If they on the other hand land in the first chute 30, which represents the main part of the breadth of the entire apparatus, they will roll down towards the second chute 31 at a considerably slower rate. As this first chute 30 is flat and broad, each ball will follow its own rolling path along the bottom 33 of the chute, which prevents the balls from jamming under their route along the chute 30.

Figure 6:
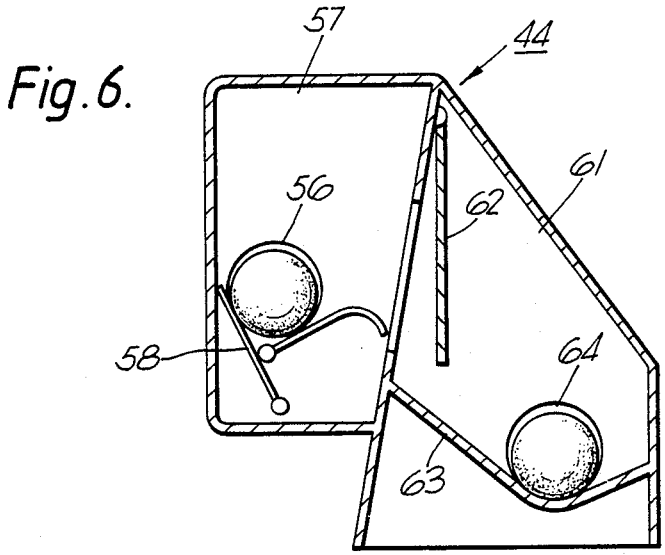

All balls therefore sooner or later will collect in the bottom of the bucket shaped chute 31. The oscillating turnstile 39 is provided in the bottom of said chute ahead of the feeding out opening 38. By the aid of oscillating movement of the turnstile 39 the balls will be fed one by one through the feeding-out opening 38 to the inclined ball tube 43, where 12 to 15 balls can be accumulated as a buffer in the system. From the accumulator tube 43 the balls are forwarded into the feeding-out apparatus 44 via an opening 56 in the side wall of an entrance chamber 57, FIG. 6. There the balls land on an intermediate spring partition 58 which is provided with longitudinal slots, not shown, in which a lattice shaped pusher means 58 can proceed. The pusher 58 advance the balls one by one through an opening 60 in the rear wall of a pressure chamber 61, which is supplied with compressed air from the blowing fan 45. The ball passes a valve 62 and rolls down along a sloping bottom 63, which at the same time as it slopes downwards also slopes at side towards the right-hand side of the chamber, which is provided with a blowing-out opening 64, to which the ball conduit 51 is connected. By gravitation the balls are thus directed one by one in the ball conduit 51. As soon as a ball enters the ball conduit 51, a counter-pressure is built up in the air in the pressure chamber 61, and thereby the valve 62 is shut. The air pressure increases until the ball is brought to move through the ball conduit 51, in order to be finally propelled through the propulsion tube 50. A new ball is thereafter brought to the pressure chamber 61 by means of a pusher, whereupon the procedure is repeated.

I claim:

1. A ball game practice apparatus, suitable for tennis practice, said apparatus comprising:

a ball catching assembly;

a ball collecting assembly comprising first elongated chute means disposed beneath said ball catching assembly, said chute means having a bottom surface;

a ball feed means associated with said ball collecting assembly;

a ball propulsion assembly connected to said ball collecting assembly via said ball feeding assembly;

ball damping means extending between said first chute means and said ball catching assembly for damping the speed of balls and preventing said balls from leaving said ball collecting assembly as a result of rebounding from said bottom surface of said chute means, said chute means conveying balls toward said ball propulsion assembly after passing said damping means.

2. An apparatus according to claim 1, wherein said bottom surface of said first chute means comprises an inclined gradient plane.

3. An apparatus according to claim 2, wherein said inclined gradient plane extends longitudinally of said first chute means.

4. An apparatus according to claim 1, wherein said bottom surface of said first chute means is rigid.

5. An apparatus according to claim 1, wherein said bottom surface of said first chute means has a breadth which is between 3 and 12 diameters of a regulation tennis ball.

6. An apparatus according to claim 5, wherein said breadth is between 4 and 12 diameters of a regulation tennis ball.

7. An apparatus according to claim 1, wherein said ball damping means comprises a net extending over said surface of said first chute means said net having a mesh larger than the diameter of a regulation tennis ball.

8. An apparatus according to claim 1, wherein said first chute means defines a path which extends towards a second chute means, said second chute extending towards said propulsion assembly for conveying a ball towards said ball propulsion assembly.

9. An apparatus according to claim 8, wherein said second chute means has arcuate shaped bottom surface.

10. An apparatus according to claim 8, wherein said propulsion assembly includes a ball projector and said second chute means is inclined towards said ball projector.

11. An apparatus according to claim 10, and further comprising a ball accumulator disposed between and connected to said ball feed means and said second chute, said feed means being connected to said ball projector for feeding balls thereto one-by-one.

12. An apparatus according to claim 11, wherein said ball accumulator is a sloping tube.

13. An apparatus according to claim 11, wherein said ball projector includes a blowing fan connection to a ball collecting chamber and a propulsion tube connected to said chamber, balls being propelled from said propulsion tube by means of air pressure in said chamber produced by said blowing fan.

14. An apparatus according to claim 11, and further comprising means for feeding balls one by one from said second chute means to said ball accumulator and for feeding balls one by one to said ball feed means.

15. An apparatus according to claim 8, wherein said first chute means is longer than said second chute means.

16. An apparatus according to claim 8, wherein said first and second chute means slope in opposite directions and said damping means is above said first and second chute means.

17. An apparatus according to claim 1, wherein said ball catching assembly comprises an inclined canvas disposed above said ball collecting assembly.

18. An apparatus according to claim 17, wherein said canvas has an upper portion and a lower portion, means provided on said upper portion of said catching assembly for directing balls which hit said canvas at a high level down towards said collecting assembly.

* * * * *